United States Patent [19]

Schumaker

[11] Patent Number: 4,800,665

[45] Date of Patent: Jan. 31, 1989

[54] PISTOL GRIP SAFETY CLIP

[76] Inventor: David C. Schumaker, 1336 Albany, Ferndale, Mich. 48220

[21] Appl. No.: 200,505

[22] Filed: May 31, 1988

[51] Int. Cl.[4] ..... F41C 27/00

[52] U.S. Cl. ..... 42/71.02; 42/70.01; 89/148

[58] Field of Search ..... 42/7, 70.01, 71.02; 89/148

[56] References Cited

U.S. PATENT DOCUMENTS

| | | | |
|---|---|---|---|
| 926,529 | 6/1909 | Wesson . | |
| 1,070,582 | 8/1913 | Browning . | |
| 1,376,165 | 4/1921 | Rosebush . | |
| 1,893,095 | 1/1933 | McCarty . | |
| 2,182,693 | 12/1939 | Harton . | |
| 2,776,602 | 1/1957 | Sturterant . | |
| 3,162,966 | 12/1964 | LaCoss . | |
| 3,492,748 | 2/1970 | Swenson . | |
| 4,162,586 | 7/1979 | Pachmayr | 42/71.02 |

*Primary Examiner*—Deborah L. Kyle
*Assistant Examiner*—Richard Klein
*Attorney, Agent, or Firm*—Basile and Hanlon

[57] ABSTRACT

A clip for a pistol having a pivotal grip safety holds the grip safety in a forward depressed position allowing operation of the firing mechanism of the pistol when the trigger is pulled. The clip is in the form of a thin band having first and second opposed legs and a flange formed at one end of each of the first and second legs and extending away from the respective leg toward the opposed leg. A central portion extends between and is joined to the opposite ends of the first and second legs and is configured to engage the pistol grip safety when the clip is mounted on the grip of the pistol. The distance between the flanges and the central portion of the clip is selected to hold the grip safety in the forward depressed position when the first and second legs in the flanges are mounted in registry with the grip of the pistol and the first and second legs and the central portion surrounds a portion of the grip and the grip safety.

6 Claims, 1 Drawing Sheet

PISTOL GRIP SAFETY CLIP

BACKGROUND OF THE INVENTION

1. Field of the Invention

The present invention relates, in general, to firearms, such as pistols, and, specifically, to pistols having grip safetys.

2. Description of the Prior Art

Firearms, and in particular, pistols, have been manufactured in many different configurations. One particular type of pistol is an automatic, 45 caliper pistol sold by Colt Industries, Inc. as model No. 1911. This pistol includes a frame having a grip and a forwardly extending, upper portion carrying a slide, barrel, trigger and springloaded hammer.

In addition to the standard finger-operated safety lever mounted on the side of the frame, this pistol, as well as many other automatic pistols, also has a grip safety pivotally mounted on the grip and interconnected with the firing mechanism to permit firing of the pistol only when the grip safety is depressed by the hand of the user grasping the pistol grip. The grip safety insures safe operation of the pistol by requiring the user to securely grasp and apply pressure to the grip to depress the grip safety before the pistol can be fired by pulling the trigger.

However, in certain situations requiring speed the user is hindered by the grip safety since he must insure that be properly holds the pistol and depresses the grip safety before pulling the trigger to fire the pistol. Particularly, in police and military activities as well as in firing competitions, the safety provisions afforded by a grip safety are outweighed by the requirements of fast firing and the ability to fire a pistol even if it is not properly grasped by the user.

Previous attempts to selectively override the grip safety have employed bands or tape placed about the grip to hold the grip safety in a continual depressed position. While somewhat effective, such bands and tape are subject to breakage which may occur at any time without notice by the user.

Thus, it would be desirable to provide a means for selectively overriding the grip safety found in certain pistols. It would be desirable to provide such a means which is removably implaceable over the grip safety to hold the grip safety in a continual depressed position such that the pistol can be fired only by pulling the trigger. It would also be desirable to provide such a grip safety override means which can be used with any existing pistols having a grip safety without requiring modifications to the pistol.

SUMMARY OF THE INVENTION

The present invention is a clip for a pistol having a pivotal grip safety which holds the grip safety in a continual depressed position making firing of the pistol dependent only on pulling the trigger.

The clip is in the form of a metallic band having first and second spaced, planar legs. Flanges are mounted on one end of each of the first and second legs and extend away from the first and second legs toward the opposed leg. A central portion is integrally connected with and extends between the opposite ends of each of the first and second legs and is adapted to engage the pistol grip safety. The distance between the flanges and the central portion of the clip is selected to hold the grip safety in a depressed position when the clip is mounted about the grip of a pistol.

In a preferred embodiment, the central portion includes an arcuate portion integrally formed with outwardly extending ribs which are joined to one end of the first and second legs.

The clips of the present invention uniquely enables the firing of a pistol having a pivotal grip safety to be dependent only on pulling the trigger when the clip is securely mounted about the grip and holds the grip safety in a continual depressed position. This enables the pistol to be more easily operated by the user since the user need not worry about properly holding the grip or applying sufficient hand pressure to depress the grip safety while pulling the trigger to fire the pistol. This is especially advantageous in police and military activities as well as in firing competitions where the safety features afforded by a grip safety are outweighed by the need for fast operation of the pistol.

The clip of the present invention is easily mounted on any conventional pistol having a grip safety without requiring modifications to the pistol. The clip is designed to securely hold the grip safety in a continual fixed position. Further, the clip is configured to be securely mounted about the grip by implacement underneath the attachable grip panels and is sized to snap around the rear portion of the grip and the grip safety.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
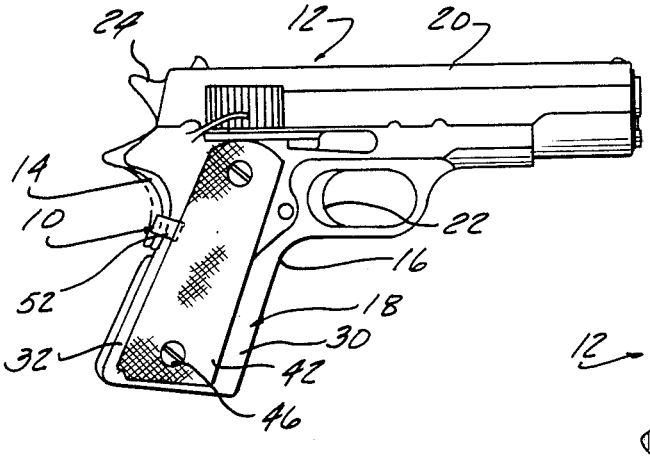
FIG. 1 is a elevational vied of a conventional automatic pistol having a grip safety showing the pistol grip safety clip of the present invention mounted thereon.

Throughout the following description and drawing, an identical reference number is used to refer to the same component shown in multiple figures of the drawing.

Figure 2:
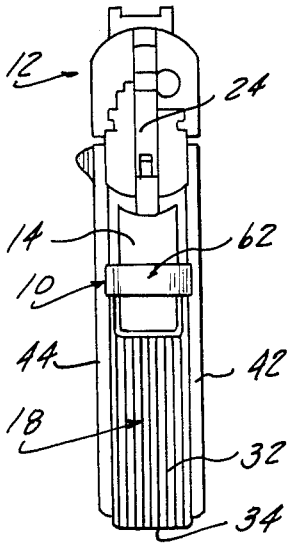
FIG. 2 is a left-hand end view of the pistol and pistol grip safety clip mounted thereon.

Referring to the drawing, and to FIGS. 1 and 2 in particular, there is illustrated a pistol grip safety clip 10 which is removably implaceable on a conventional automatic pistol 12 and holds the pistol grip safety 14 in a continual depressed position allowing firing of the pistol 12 to occur when the trigger is pulled by the user of the pistol 12.

The pistol grip safety clip 10 of the present invention is adapted for use on any type of pistol having a grip safety, such as an automatic pistol 12 sold by the Colt Firearms Manufacturing Company, Inc. under model number 1911. This pistol 12 includes a frame 16 on which is mounted a grip 18 and a forwardly extending upper portion 20 carrying a slide, bolt, trigger 22 and a spring-loaded hammer 24. The firing mechanism employed in the pistol 12 may be of any conventional construction, such as that disclosed in U.S. Pat. Nos. 2,776,202 and 3,492,748, the applicable portions of which are hereby incorporated by reference to describe the construction and operation of a typical automatic pistol firing mechanism.

The grip 18 is hollow and is formed of a front grip portion 30, a rear portion 32 and an open bottom end 34. The hollow interior of the grip 18 is adapted to receive a cartridge magazine, not shown, which slides through a bore formed in the interior of the grip 18 in a channel or recess 36 formed in the front and/or rear portions 30 and 32 of the grip 18 as shown in FIG. 5.

Transverse apertures 38 and 40 are formed in each of the sides of the grip 18 and communicate with the hollow interior of the grip 18. A pair of grip panels 42 and 44 are removably mounted by fasteners 46 to the sides of the grip 18 and cover the apertures 38 and 40, respectively. The girp panels 42 and 44 have a rough outer surface and are preferably formed of a lightweight material, such as plastic.

As shown in FIGS. 1 and 2, the grip safety 14 is pivotally mounted at one end to the pistol 12 and is interconnected to the internally disposed firing mechanism to permit firing of the pistol 12 when the trigger 22 is pulled towards the grip 18 only when the girp safety 14 is depressed to a forward position as shown by the solid lines in FIG. 1. When not depressed, the pistol grip safety 14 assumes the position shown by the dotted lines in FIG. 1 in which the firing mechanism of the pistol 12 is rendered inoperative.

Figure 3:
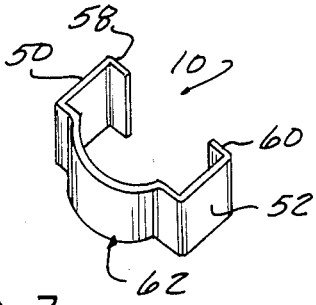
FIG. 3 is a perspective view of the pistol grip safety clip of the present invention.
Figure 4:
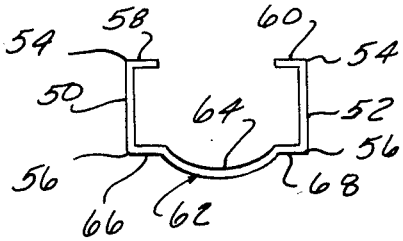
FIG. 4 is a plan view of the pistol grip safety clip shown in FIG. 3.
Figure 5:
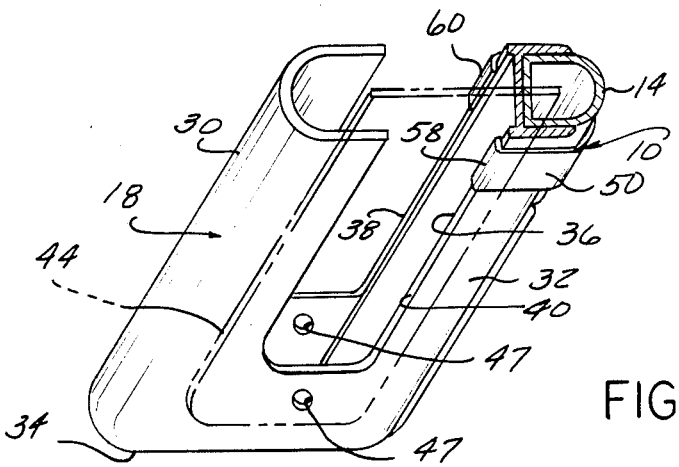
FIG. 5 is a partial, perspective view showing the mounting of the pistol grip safety clip of the present invention on the grip of the pistol shown in FIG. 1.

As shown generally in FIGS. 1 and 2, and in greater detail in FIGS. 3, 4 and 5, the pistol grip safety clip 10 of the present invention is in the form of a elongated strip having a relatively small thickness which is bent or shaped to the configuration shown in FIGS. 3 and 4. The clip 10 is formed of any suitable high strength material, such as a metal.

As shown in FIGS. 3 and 4, the clip 10 is formed with first and second planar, opposed, spaced legs 50 and 52, respectively. Each of the first and second legs 50 and 52 has opposed first and second ends 54 and 56, respectively. The legs 50 and 52 are spaced apart a distance equal to the width of the grip 18 of the pistol 12 so as to engage the side walls of the grip 18 when the clip 10 is mounted on the grip 18 as described hereafter.

First and second flanges 58 and 60, respectively, are formed on the clip 10. The flanges 58 and 60 are integrally joined to the first end 54 of each of the legs 50 and 52, respectively, of the clip 10 and extend away from the respective legs 50 and 52 toward the opposed leg 50 and 52. The flanges 58 and 60 have a length sufficient to wrap around the rear portion 32 of the grip 18, as shown in FIG. 5, to securely mount the clip 10 to the grip 18 and yet be spaced from the magazine channel 36 in the grip 18.

The clip 10 also includes a central portion denoted in general by reference number 62 which extends between and is integrally joined to the second ends 56 of the first and second legs 50 and 52. The central portion 62 is configured to conform to the shape of and engage the grip safety 14. Further, the distance or spacing between the flanges 58 and 60 and the central portion 62 is selected to hold the grip safety 14 in a forward depressed position, as shown in solid in FIG. 1, when the clip 10 is on the grip 18 and the flanges 58 and 60 of the clip 10 engage the inside walls bounding the transverse apertures 38 and 40 in the grip 18.

In a preferred embodiment, the central portion 62 of the clip 10 is formed of a central arcuate portion 64 which terminates in outwardly extending ribs 66 and 68 which are integrally joined to the second ends 56 of the legs 50 and 52. The arcuate shape of the central portion 64 and the length and shape of the ribs 66 and 68 are selected so as to be complementary to the shape of the grip safety 14 so as to snugly engage the grip safety 14 when the clip 10 is mounted on the grip 18 over the grip safety 14.

In use, the grip safety 14 will normally be biased to the extended position shown by the dotted lines in FIG. 1 rendering the firing mechanism of the pistol 12 inoperative. The grip panels 42 and 44 are first removed from the pistol 12 by removing the fasteners 46 from the apertures 47 in the grip 18. Next, the grip safety 14 is depressed to the forward position shown in solid in FIG. 1 and the clip 10 is inserted about the rear portion 32 of the grip 18 until the flanges 58 and 60 of the clip 10 snap around and firmly engage the surfaces of the grip 18 bounding the transverse apertures 38 and 40 in the grip 18 and the central portion 62 engages the grip safety 14. When pressure on the grip safety 14 is removed, the predetermined spacing between the flanges 58 and 60 and the central portion 62 of the clip 10 insures that the grip safety 14 remains in the depressed position rendering the operation of the firing mechanism of the pistol 12 dependent only on the trigger 22. The grip panels 42 and 44 are then reattached to the grip 18 by inserting the fasteners 46 therethrough into corresponding apertures 47 formed in the grip panels 42 and 44 and the grip 18 as shown in FIGS. 1 and 5. The grip panels 42 and 44 when remounted on the grip 18 firmly hold the clip 10 in position.

In this configuration, the grip safety 14 is in its depressed position rendering the firing mechanism of the pistol 12 operative such that the pistol 12 can be fired by merely depressing or pulling the trigger 22.

In summary, there has been disclosed a unique clip for use on a pistol having a grip safety which securely holds the grip safety in a depressed position rendering operative the firing mechanism of the pistol. The clip is of simple construction and may be easily attached to any conventional pistol having a grip safety by implacing the clip about a rear portion of the grip between the grip and the overlying, attachable grip panels.

The use of the clip of the present invention overrides the function of the grip safety in operating an automatic pistol and finds advantageous use in those situations where speed of firing, which is inhibited by the presence of the grip safety, outweighs the safety features provided by the grip safety.

What is claimed is:

1. In a pistol having a grip, a forwardly extending upper portion connected to the grip, a grip safety pivotally mounted on the grip and movable forwardly to a depressed position when engaged by the hand of the user, transverse apertures formed in opposed sides of the grip and removable grip panels mountable over the apertures in the grip, the improvement comprising:

a clip removably mountable over a portion of the grip and the grip safety, the clip having:

first and second opposed legs;

a flange formed at one end of each of the first and second legs and extending from the respective leg toward the opposed leg; and a central portion joined to and extending between the opposite ends of the first and second legs;

the spacing between the flanges and the central portion of the clip being selected to hold the grip safety in the forward depressed position when the flanges are mounted in registry with the grip and the first and second legs and the central portion of the clip surround a portion of the pistol grip and the grip safety.

2. The improvement of claim 1 wherein the first and second legs have a small thickness to fit between the grip panels and the grip when the clip is mounted on the grip.

3. The improvement of claim 1 wherein the first and second legs are spaced apart a distance to fit in registry with opposed sides of the pistol grip.

4. The improvement of claim 1 wherein the central portion has an arcuate shape to conform to the shape of the pistol grip safety.

5. The improvement of claim 1 wherein the clip is formed of a metallic material.

6. The improvement of claim 1 wherein the central portion includes:

first and second inwardly extending ribs joined to and extending away from the first and second legs, respectively; and a central arcuate portion extending between and joined to the first and second ribs and configured to conform to the shape of the pistol grip safety.

* * * * *